US007044187B2

(12) United States Patent
Bebensee et al.

(10) Patent No.: US 7,044,187 B2
(45) Date of Patent: May 16, 2006

(54) DEVICE FOR TRANSFERRING A SUBSTANCE APPLIED TO A SUPPORT TAPE IN THE FORM OF A FILM TO A SUBSTRATE

(75) Inventors: Ingo Bebensee, Hannover (DE); Wulf Hermannsen, Ronnenberg (DE); Oliver Bartling, Hannover (DE)

(73) Assignee: Pritt Produktionsgesellschaft mbH, Hannover (DE)

( * ) Notice: Subject to any disclaimer, the term of this patent is extended or adjusted under 35 U.S.C. 154(b) by 0 days.

(21) Appl. No.: 10/181,246

(22) PCT Filed: Jan. 8, 2001

(86) PCT No.: PCT/EP01/00127

§ 371 (c)(1),
(2), (4) Date: Jul. 15, 2002

(87) PCT Pub. No.: WO01/51394

PCT Pub. Date: Jul. 19, 2001

(65) Prior Publication Data

US 2002/0189765 A1 Dec. 19, 2002

(30) Foreign Application Priority Data

Jan. 15, 2000 (DE) ..... 100 01 465

(51) Int. Cl.
*B32B 35/00* (2006.01)

(52) U.S. Cl. ..... 156/540; 156/577; 156/581; 118/76

(58) Field of Classification Search ..... 118/76, 118/200, 242, 257; 225/46; 242/160.4, 171, 242/588.6; 156/486, 523, 240, 574, 577, 156/580, 581, 428, 590, 540; 100/210, 295, 100/155 R, 7, 76, 156

See application file for complete search history.

(56) References Cited

U.S. PATENT DOCUMENTS

| | | | | |
|---|---|---|---|---|
| 3,551,251 | A | 12/1970 | Sato et al. | |
| 4,664,741 | A | 5/1987 | Fechner et al. | |
| 4,853,074 | A | 8/1989 | Manusch et al. | |
| 4,997,512 | A * | 3/1991 | Manusch | 156/486 |
| 5,430,904 | A | 7/1995 | Ono et al. | |
| 5,820,728 | A | 10/1998 | Stevens et al. | |
| 6,481,485 | B1 * | 11/2002 | Herrmannsen et al. | 156/577 |

FOREIGN PATENT DOCUMENTS

| | | |
|---|---|---|
| EP | 0 360 045 | 3/1990 |
| RU | 2 143 394 C1 | 12/1999 |
| SU | 672063 | 7/1979 |
| WO | WO 0010897 * | 6/2001 |

* cited by examiner

*Primary Examiner*—Chris Fiorilla
*Assistant Examiner*—Sing P. Chan
(74) *Attorney, Agent, or Firm*—Stephen D. Harper; Glenn E. J. Murphy

(57) ABSTRACT

A device for transferring film coating to a substrate with a carrier tape, the device having an applicator foot with at least one recess on the side facing the substrate during application of the coating to substrate.

11 Claims, 3 Drawing Sheets

DEVICE FOR TRANSFERRING A SUBSTANCE APPLIED TO A SUPPORT TAPE IN THE FORM OF A FILM TO A SUBSTRATE

CROSS-REFERENCE TO RELATED APPLICATIONS

This application is a U.S. National Stage application filed under 35 U.S.C. § 371, claiming priority of International Application No. PCT/EP01/00127, filed Jan. 8, 2001 in the European Patent Office, and DE 100 01 465.8, filed Jan. 15, 2000 in the German Patent Office, under 35 U.S.C. §§ 119 and 365.

BACKGROUND OF THE INVENTION

The invention relates to a device for transferring to a substrate, such as a writing or drawing sheet, a substance applied in the form of a film to a carrier tape, comprising a housing in which a storage reel for the film-coated carrier tape and an empty reel for receiving the carrier tape with the coating removed are arranged, wherein the film-coated carrier tape is guided over an applicator foot with an applicator edge, around which the carrier tape is looped.

Hand devices of that kind for transferring a film (for example, adhesive, covering material, marking colorant, etc.) are known. In that case different realisations of the designs of the applicator foot are known in pursuit of easy motion and good capability of transfer of the film to the substrate. Thus, the applicator foot can, for example, be equipped with an applicator roller which preferably has a rubber-elastic running surface. However, since the outer diameter of an applicator roller appropriate to the function cannot be kept as small as desired, because good brushing against the substrate requires a minimum thickness for the elastic running ring and rotational mobility presupposes a sufficient difference between stub axle and outer diameter, such a roller has disadvantages. Accordingly, most solutions for the applicator foot comprise an applicator strip which has advantages relative to an applicator roller, since a sharper unwinding of the carrier tape is possible in the transfer phase, whereby the detached portion after completed transfer has less tendency to formation of a wavy edge. There against, a disadvantage relative to a solution with an applicator roller is that in the case of the applicator strip the carrier tape is guided over this with a friction couple, which depending on the respective quality of the carrier tape can lead to an undesired heavy motion.

A device according to the category is known from, for example, U.S. Pat. No. 5,430,904. In this device the applicator foot in the region looped around by the carrier tape is provided with a slide element of a friction-reducing rubber-like material which is fastened to the applicator foot. This slide element is to serve the purpose of achieving a faultless transfer of the film to the substrate. However, it has proved that the easy motion of the device and the transfer of the film to the substrate is still worthy of improvement.

Moreover, another device according to the category is known from EP 0 360 045 A2. In this device the applicator foot has, adjacent to a rigid applicator strip at the free end, an end region which is capable of springing away relative to the applicator strip and which defines a presser edge and consists of mutually adjacent portions able to resiliently spring out substantially independently of one another perpendicularly to the longitudinal centre plane relative to the applicator strip, but formed to be non-yielding in the direction of this longitudinal centre plane. These end regions in that case are preferably formed from resilient tongues disposed adjacent to one another, wherein, however, each tongue is deflectable quite independently of the adjacent tongues. A good adaptation to uneven substrates is indeed possible with such an applicator foot, but an applicator foot of that kind with several tongues arranged adjacent to one another is relatively costly to produce.

The object of the invention is accordingly to so improve a device according to category that the easy motion and faultless transfer of the film to the substrate are improved by simplest possible means with particular consideration of economic capability of manufacture.

According to the invention this object is met with a device of the kind stated in the introduction by the applicator foot being provided at least in the region of its underside facing the substrate with at least one recess.

DESCRIPTION OF THE INVENTION

In departure from known devices of this kind, the underside of the applicator foot thus does not have a flat surface in the region of the applicator edge or in the region adjoining the applicator edge, but is provided with recesses, whereby the surface of the applicator foot in this region is greater than the support area of the carrier tape on the applicator foot, i.e. the contact area between the applicator foot and the carrier tape is very small. Substantially improved slide properties thereby result, in particular hardly any stretching in the material layer (for example, adhesive) to be transferred occurs, the carrier tape does not slip through during use and running properties remain stable until the tape end. In addition, blockages due to high friction do not occur. The manufacture of the device is not thereby made difficult, since the (injection-moulding) tool has to be rebuilt or modified only once.

In a particularly advantageous embodiment it is provided that the at least one recess extends into the region of the applicator edge. Since the carrier tape during use is pressed against the applicator foot particularly in the region of the applicator edge, it is especially advantageous if the contact area is also reduced in this region by the recesses.

In order to keep the contact area between the carrier tape and the applicator foot as small as possible, it is advantageous to provide several recesses arranged adjacent to one another and extending from the applicator edge in the conveying direction of the carrier tape.

The recesses can in that case be arranged parallelly and they can also be arranged to run conically towards the applicator edge, other geometric formations also being possible.

Additionally or alternatively at least one recess can be arranged transversely to the conveying direction in front of the applicator edge as seen in the conveying direction and can be formed as a collecting groove for film coating residues. Residues not transferred to the substrate can be caught by this collecting groove and do not impair the functional capability of the device; in particular, these residues do not pass into the region of the empty reel. The easy mobility of the device is thus further improved.

In a further advantageous embodiment that the applicator foot can also be provided with recesses on its upper side.

The invention is explained in more detail by way of example in the following by reference to the drawing, in which:

DESCRIPTION OF THE DRAWINGS

In FIG. 1 there are illustrated—of a device according to the invention for transferring to a substrate a substance applied in the form of a film to a carrier tape—only the parts which are of significance for the invention, namely substantially only an applicator foot generally denoted by 1. This applicator foot 1 is equipped with an applicator strip 2 with a front applicator edge 3, around which is guided, over the applicator strip 2, a coated carrier tape 2 coming from a storage reel (not illustrated) of the device. After transfer of the coating 5 to a substrate it is guided back as empty tape 6 to a winding-up reel (not illustrated) of the device, the reel being arranged in the housing (not illustrated) of the device.

Figure 1:
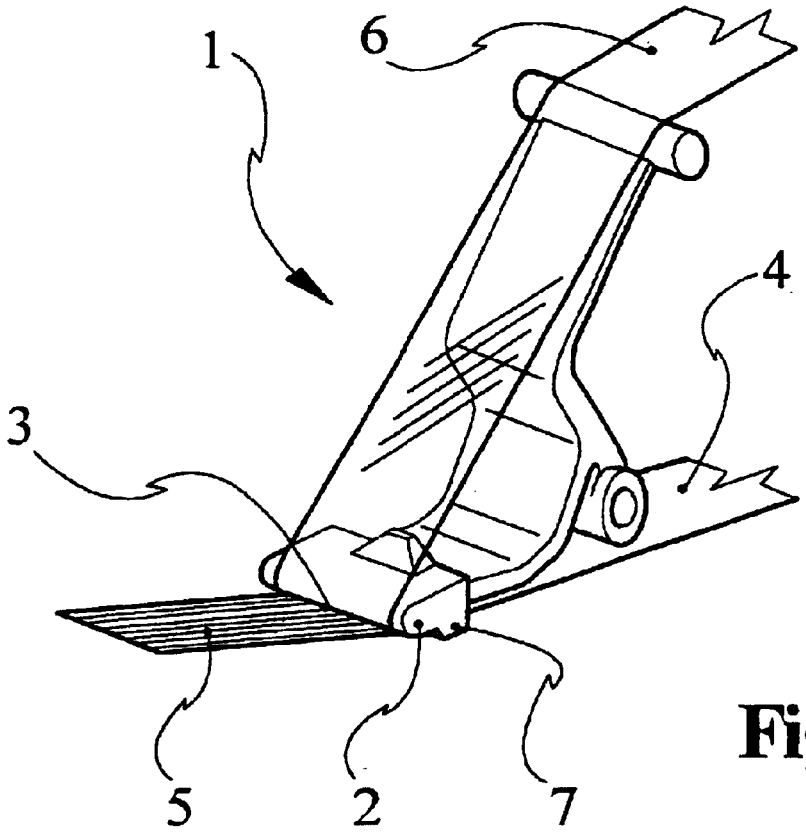
FIG. 1 shows, in perspective illustration, an applicator foot of a device according to the invention.
Figure 2:
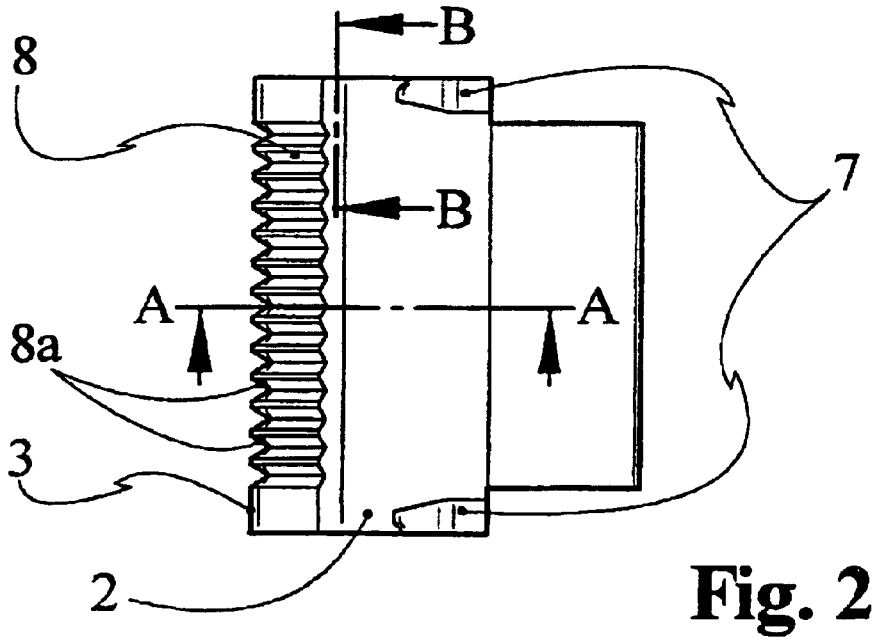
FIG. 2 shows a view from below of the applicator strip of the applicator foot.
Figure 3:
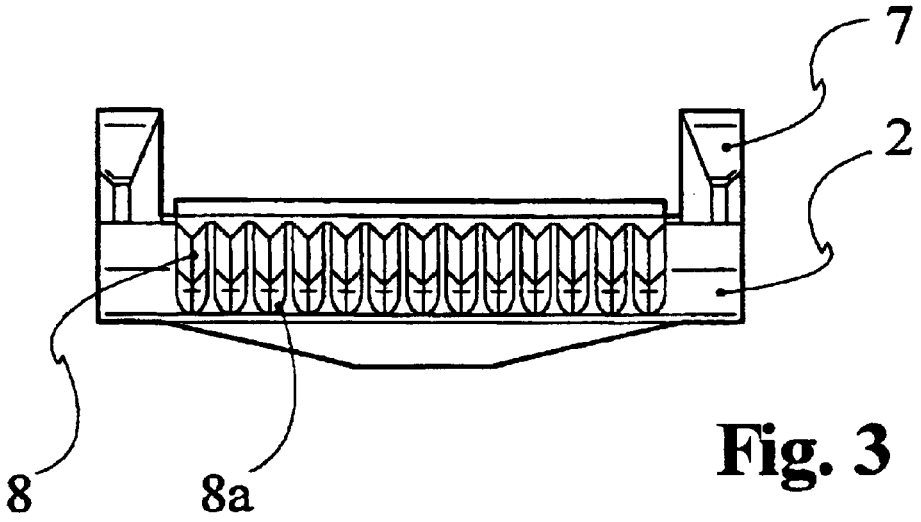
FIG. 3 shows a view from the front of the applicator strip in an arrangement disposed overhead relative to the use position.
Figure 4:
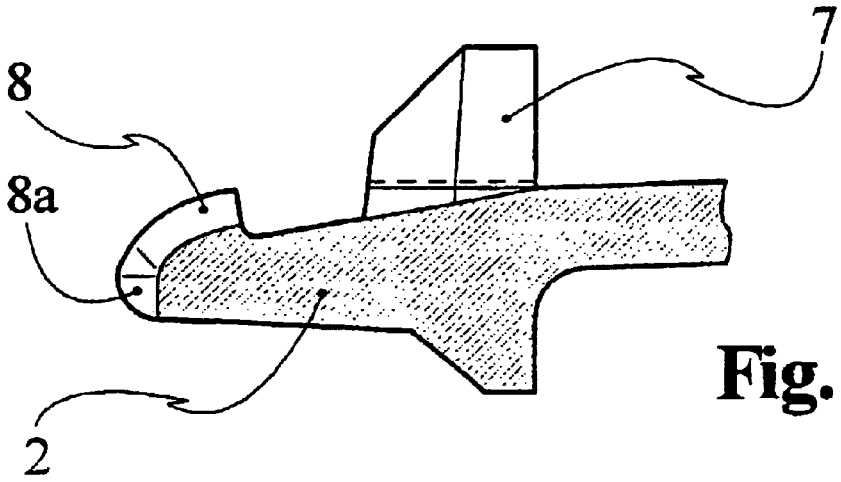
FIG. 4 shows a section according to the line A—A in FIG. 2.

Tape guide ears 7, between which the carrier tape 4 coming from the storage reel of the device is guided, are provided in usual manner on both sides at the underside of the applicator strip 2 at the end seen in conveying direction, i.e. opposite the applicator edge 3.

According to the invention it is now provided that the applicator foot 1 is provided at the least in the region of its underside facing the substrate, i.e. at the side having the tape guidance ears 7, and in the region of its applicator strip 2 with, preferably, several recesses 8 which are arranged substantially in conveying direction and which in the case of the embodiment are disposed adjacent and parallel to one another and parallel to the conveying direction. These recesses 8 in that case preferably extend into the vicinity of the applicator edge 3, those regions of the recesses being denoted by 8*a*. These notch-shaped recesses 8 or 8*a* have the consequence that the applicator strip 2 in this region has a substantially larger surface than the surface of the carrier tape 4, so that the carrier tape 4 bears against the applicator strip 2 only by very small contact areas.

The recesses 8 and 8*a* can in principle have any desired shape or arrangement and the number of recesses 8 is in principle as desired, being obviously dependent on the size of the applicator strip 2. By virtue of these notch-shaped recesses 8, 8*a* not only a small contact area for the carrier tape 4 is given, but a good capability of transfer to uneven substrates is also guaranteed.

Figure 5:
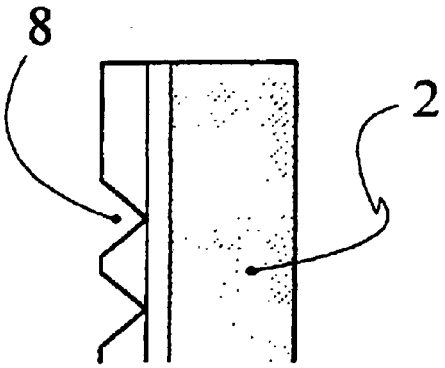
FIG. 5 shows a section according to the line B—B in FIG. 2.
Figure 6:
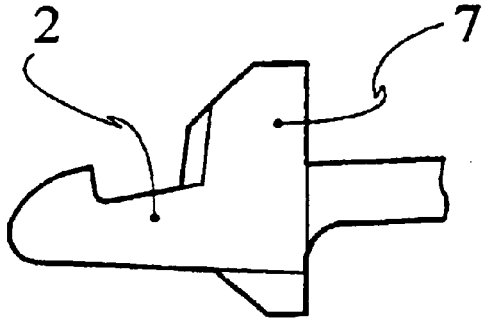
FIG. 6 shows a view from the side of the illustration according to FIG. 3.

In an alternative form of embodiment, which is not illustrated, the recesses 8 can also be formed to run conically towards the applicator edge 3, i.e. the individual notch-shaped recesses 8 are then arranged to be non-parallel, but to run forwardly to a tip or conically preferably symmetrically relative to the centre axis. The form of recesses 8 illustrated in, in particular, FIG. 5 is in fact preferably notch-shaped, but obviously other geometric designs are also possible.

Figure 7:
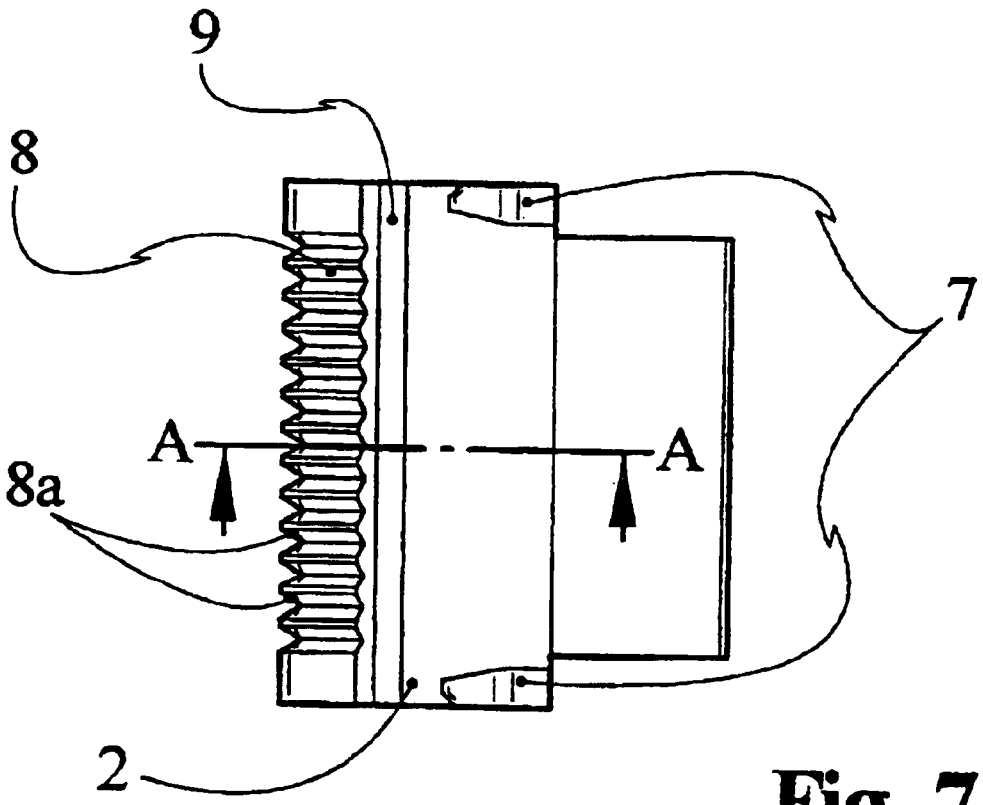
FIG. 7 shows a view from below of a modified applicator strip of the applicator foot and FIG. 8 shows a section according to the line A—A in FIG. 7.
Figure 8:
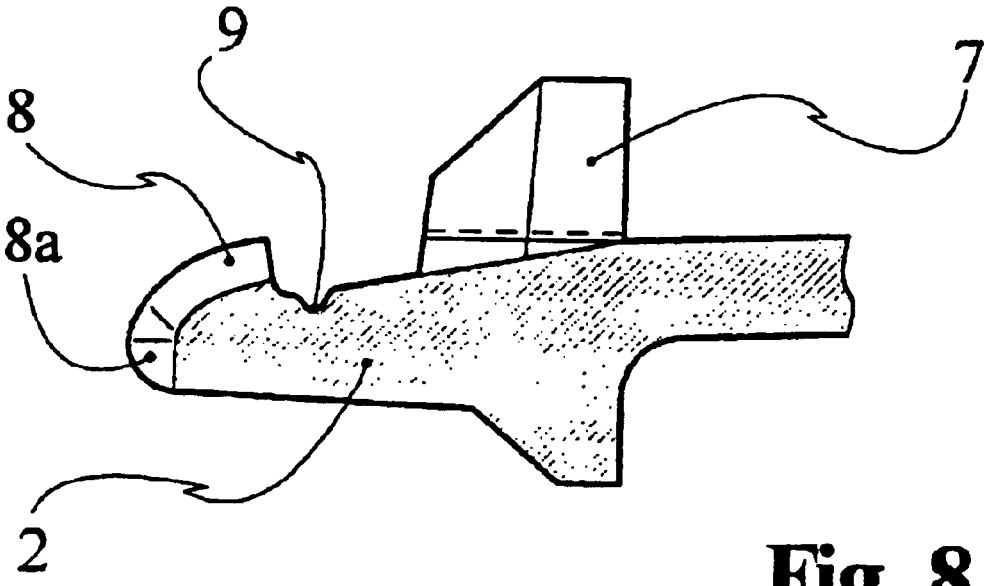

A further form of embodiment of the invention is illustrated in FIGS. 7 and 8. In distinction from the form of embodiment according to FIGS. 1 to 6, in this form of embodiment it is additionally provided that at least one recess 9 is arranged transversely to the conveying direction in front of the applicator edge 3 as seen in the conveying direction and is formed as a collecting groove for film coating residues. Film coating residues can then accumulate in this collecting groove 9 and do not pass into the region of the empty reel, so that a faultless winding-up of the empty tape 6 is guaranteed and the easy motion of the device is ensured.

The invention is obviously not restricted to the illustrated examples of embodiment. Further embodiments are possible without departing from the basic concepts. Even if this is not illustrated in the drawings, it can also be provided in accordance with the invention that the applicator foot 1 has only a recess 9 transverse to the conveying direction, whilst the applicator strip 2 is otherwise constructed to be flat, i.e. does not have any recesses 8, 8*a*.

What is claimed is:

1. A device for transferring a substance to a substrate, comprising a carrier tape to which the substance is applied in the form of a film, a housing in which are arranged a storage reel for the film-coated carrier tape and an empty reel for receiving the carrier tape after the substance has been applied to the substrate, and an applicator foot for applying the substance to the substrate around which the carrier tape is looped, wherein the applicator foot has an underside disposed to face the substrate and a plurality of recess in said underside, said a plurality of recesses spacing portions of underside said from said carrier tape and said carrier tape bearing against said applicator foot at spaced contact areas wherein said plurality of recesses are adjacent to one another and extend from an applicator edge parallel to the direction of travel of the carrier tape.

2. The device of claim 1, wherein said plurality of recesses extend into the region of the applicator edge.

3. The device of claim 2, wherein the recesses are parallel.

4. The device of claim 2, wherein the recesses are arranged conically towards the applicator edge.

5. The device of claim 2, wherein the underside has at least one of said at least one recess arranged transversely to the carrier tape.

6. The device of claim 2, wherein the applicator foot has an upper side that has at least one recess.

7. The device of claim 1, wherein the underside has at least one of said at least one recess arranged transversely to the carrier tape.

8. The device of claim 1, wherein the applicator foot has an upper side that has at least one recess.

9. A device for transferring a substance to a substrate, comprising a carrier tape to which the substance is applied in the form of a film, a housing in which are arranged a storage reel for the film-coated carrier tape and an empty reel for receiving the carrier cape after the substance has been applied to the substrate, and an applicator foot for applying the substance to the substrate around which the carrier tape is looped, wherein the applicator foot has an applicator edge and an underside disposed adjacent the applicator edge to face the substrate and a plurality of recesses adjacent to one another which extend from the applicator edge toward the underside, parallel to the direction of travel of the carrier tape.

10. The device of claim 9, wherein the recesses are parallel.

11. The device of claim 9, wherein the recesses are arranged conically towards the applicator edge.

* * * * *

UNITED STATES PATENT AND TRADEMARK OFFICE

CERTIFICATE OF CORRECTION

PATENT NO. : 7,044,187 B2
APPLICATION NO. : 10/181246
DATED : May 16, 2006
INVENTOR(S) : Bebensee et al.

It is certified that error appears in the above-identified patent and that said Letters Patent is hereby corrected as shown below:

Title page, (75) Inventors, delete “Hermannsen” and insert therefor --Herrmannsen--.

Column 4, line 54, delete “cape” and insert therefor --tape--.

Signed and Sealed this

Twenty-second Day of August, 2006

JON W. DUDAS
*Director of the United States Patent and Trademark Office*